United States Patent [19]

Norton, Sr.

[11] Patent Number: 4,536,972

[45] Date of Patent: Aug. 27, 1985

[54] SHELF LOWERING AND VIAL STOPPERING FREEZE-DRYING APPARATUS

[76] Inventor: Thomas E. Norton, Sr., 302 Valley Forge Rd., Cinnaminson, N.J.

[21] Appl. No.: 614,346

[22] Filed: May 25, 1984

[51] Int. Cl.[3] ..... F26B 13/30; B65B 7/28

[52] U.S. Cl. ..... 34/92; 53/102; 53/264

[58] Field of Search ..... 34/92; 53/102, 264

[56] References Cited

U.S. PATENT DOCUMENTS 3,537,233 11/1970 Costello et al. ..... 53/264

3,775,942 12/1973 Powell et al. ..... 53/264

*Primary Examiner*—John J. Camby

[57] ABSTRACT

Upper shelves supported within a tall vacuum drying chamber of freeze drying apparatus are positioned above eye level sighting of an operator of average height, rendering loading of vials upon these upper shelves and unloading therefrom, a difficult task. Typically, the vials, containing pharmaceutical or biological liquid, have stoppers loosely engaged therein. Means are provided for stacking the upper shelves to an appropriate sighting level for sequential loading which returns the shelves to their initial position. The loaded shelves are again lowered to a comfortable height for unloading thereof after all vials on lower and upper shelves have their loosely fitted stoppers fully engaged within their vials by stoppering means.

13 Claims, 7 Drawing Figures

SHELF LOWERING AND VIAL STOPPERING FREEZE-DRYING APPARATUS

Statement of the Invention

The present invention relates to freeze drying apparatus having a tall drying chamber wherein upper shelves therein are substantially above eye level sighting of an operator of average height, and more particularly to means for depressing the upper shelves to convenient levels for loading and unloading.

BACKGROUND AND SUMMARY OF THE INVENTION

U.S. Pat. No. 3,775,942, issued to Powell et al and assigned to the present assignee, discloses freeze drying apparatus wherein shelves therein may be adjustably spaced on pegboard support members by means of holes provided therein at predetermined locations, and to additional means for stoppering the vials.

U.S. Pat. No. 3,448,556, discloses freeze drying apparatus wherein partially stoppered vials containing the product are fully stoppered on shelves disposed between an uppermost shelf which moves downwardly and a lowermost shelf which is caused to move upwardly.

Other patents disclose diverse mechanisms useful in lyophilization, including means for adjusting the space between adjacent shelves to accommodate containers of varying sizes, vacuum capping of containers, automatic vial stoppering, shelf adjustment and movement, and the like. As far as known, none teach or suggest freeze drying apparatus having a tall vacuum drying chamber wherein upper shelves therein are depressable to eye level height in order to facilitate manual loading thereon of partially stoppered containers with product therein, typically pharmaceutical or biological liquids, while sequentially elevating the loaded shelves to their initial position. Lower shelves, of course, will be individually manually loaded, as accomplished heretofore.

Current trends in the pharmaceutical freeze drying industry lean toward the utilization of larger and taller vacuum drying chambers in order to accommodate larger batch sizes of product with accompanying cost savings. The design of these larger chambers, however, requires the upper shelves to be positioned considerably above the head of an operator of average height, rendering manual loading and unloading of the upper shelves difficult.

The present invention provides apparatus which permits an intermediately positioned shelf to function as a supporting shelf for the stacking thereon of the upper shelves. That is, the shelf immediately above the supporting shelf is depressed to rest upon the supporting shelf. Simultaneously therewith, each of the remaining upper shelves is similarly moving downwardly resulting in a sequential stacking of the upper shelves on the supporting shelf, the uppermost shelf within the chamber forming the uppermost shelf of the stack. The stacked uppermost shelf, now lowered to about eye level height, is manually loaded before being elevated a few inches to a predetermined position to thus expose the next shelf therebelow for manual loading, and so on. After each of the upper shelves has been returned to its original position, the supporting shelf is manually loaded. Shelves below the supporting shelf may already have been manually loaded as in the past.

It is thus apparent that an operator of average heig may readily manually load a large vacuum dryi chamber wherein the uppermost shelf to be loade while in its initial or original position within the char ber, may be almost 8 feet above the floor, as in t apparatus to be described hereinafter.

After the product is freeze dried, the operator ac vates stoppering means which continuously elevates shelves toward a stationary uppermost shelf (which not loaded) for complete stoppering of the partial stoppered vials on each of the shelves in sequenti ascending order. The stoppering means of the prese apparatus is similar to that disclosed in the aforeme tioned patent to Powell et al assigned to the prese assignee.

DETAILED DESCRIPTION OF THE INVENTION

Figure 1:
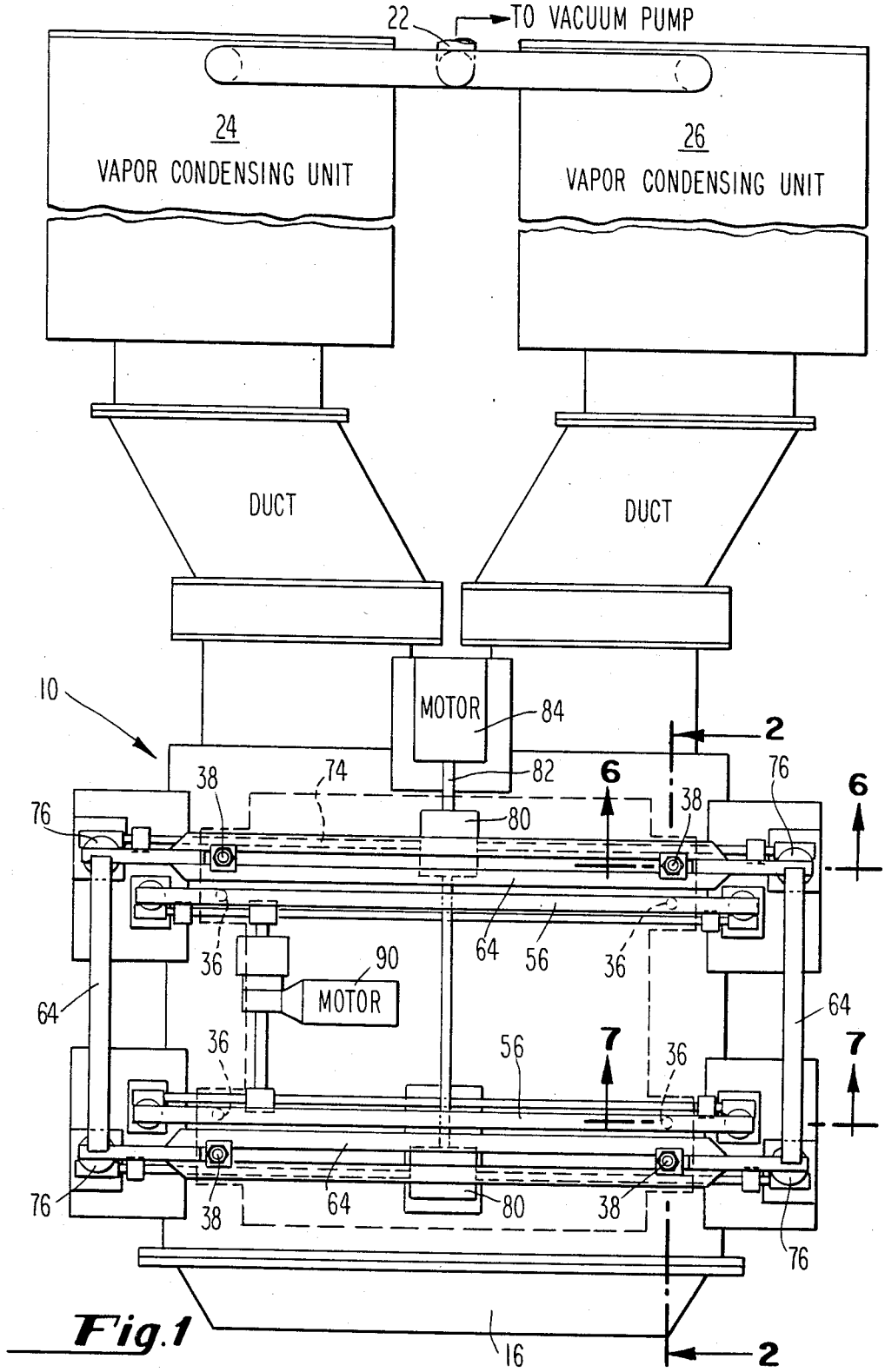
FIG. 1 is a plan view of the freeze drying apparatus the present invention.

In order to more fully appreciate the contribution the pharmaceutical freeze drying industry of the prese invention, steps in a typical freeze drying of biologic or pharmaceutical products are recited below.

(a) the product, typically a biological or pharmaceu cal liquid, is introduced into a small vial with a stopp which is usually slotted to permit drying of the produ when the stopper loosely engages the vial (b) the vials with product are loaded onto shel supported within the vacuum drying chamber (c) the product is caused to freeze by passage of suitable heat transfer fluid through passageways form in the shelves (d) the chamber is evacuated to a pressure lower th the vapor pressure of the frozen solid by outside pun means (e) energy is supplied to shelves by passage therein suitable heat transfer fluid through the aforemention passageways to evaporate solvent for drying the pr uct (f) solvent vapors are condensed by condenser mea which has previously been cooled to a suitable l temperature and is continuously refrigerated (g) optionally, an inert gas, typically nitrogen, is troduced into the chamber after product is dried (h) vials are completely stoppered (i) vacuum remaining is broken (j) freeze dried product is removed or unloaded It is apparent from the above that the upper shel must be depressed and elevated during the loading eration, and depressed again for unloading, care bei exercised during unloading to initially unload the s porting shelf prior to sequentially stacking thereon the loaded upper shelves for manual unloading.

Referring now to the drawings, and initially to FI 2 thereof, freeze drying apparatus 10 includes a t vacuum drying chamber 12 formed in part by housing member 14. Chamber 10 is provided with a door 16 hinged to the housing and a plurality of latching mechanisms (not shown) will maintain the door in sealed disposition to the chamber. One or more windows may be provided in the door to permit observation within the chamber.

Shelves 20 are supported within chamber 12, approximately 8 feet high, by means to be hereinafter described. The freeze drying apparatus described herein is provided with 17 shelves, for example, as indicated, which are horizontally disposed, vertically aligned, and typically comprise flat steel plates approximately 1" thick×6 feet deep×5 feet wide. Shelves 20 have conventional circulating bores or passageways therein (not shown) for circulation of suitable heat transfer fluid therethrough for selectively refrigerating and heating the shelves during a freeze drying cycle. Flexible hoses (not shown), suitably polytetrafluoroethylene, communicate between the bores or passageways in each of the shelves (as shown and described in U.S. Pat. No. 3,755,942) with a conventional refrigeration and heating unit (not shown). A conduit 22 couples a vacuum pump (not shown) with chamber 12 for evacuation thereof through vapor condensing units 24 and 26, and ducts (as indicated).

Figure 5:
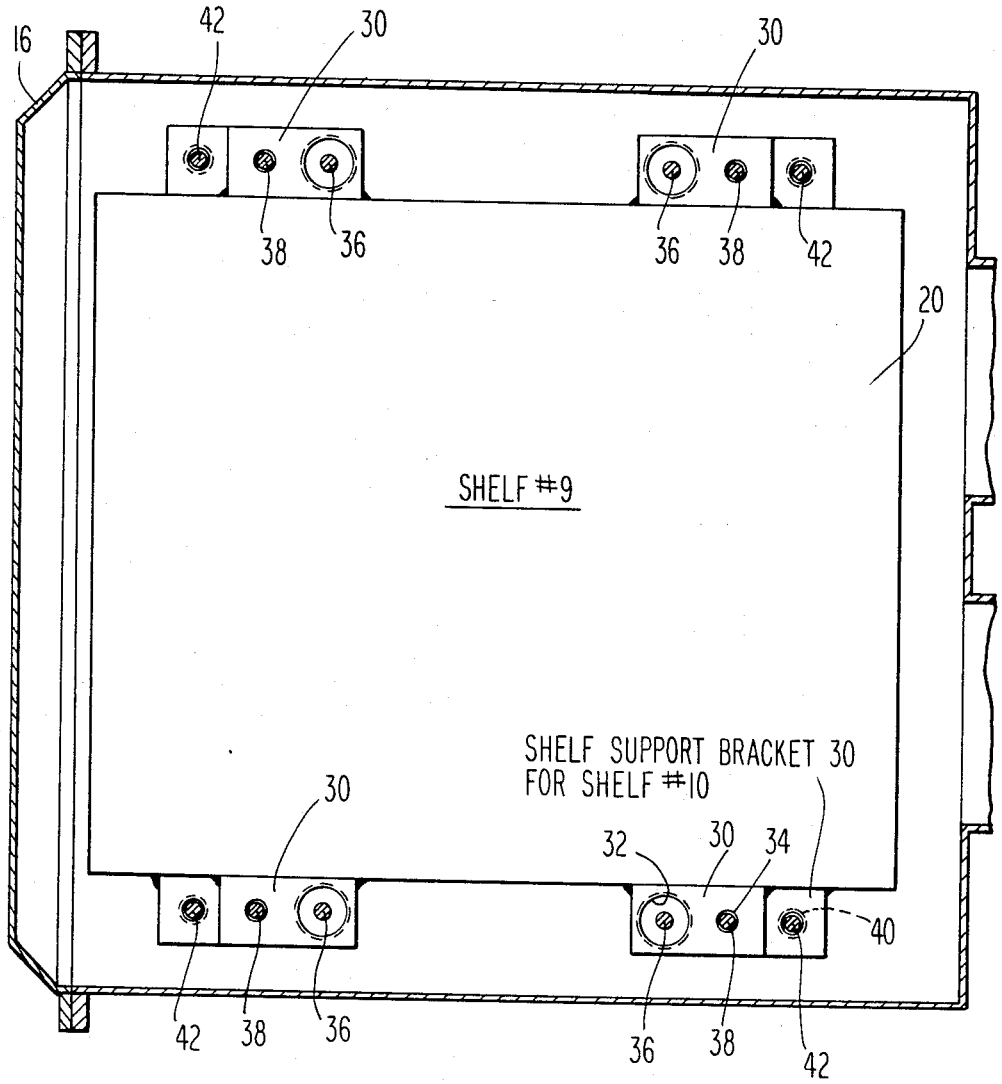

Shelves 20 are provided with a pair of spaced shelf support blocks or brackets 30 along each of both side edges thereof, i.e., typically along the 6 foot depth dimension. The blocks 30 extend outwardly from the sides of the shelves in opposing relationship (shown clearly in FIG. 5), are coplanar with the shelves to which they are conveniently welded or threadedly mounted.

Shelf support blocks 30 associated with shelves #1 throught #9 are provided with a pair of openings 32 (FIG. 4) and 34 (FIG. 3) for passage therethrough of lifting rods 36 and stoppering rods 38 respectively. Shelf support blocks 30 associated with shelves #10 through #16 are provided with pair of openings 34 (FIG. 3) and 40 (FIG. 2) for passage therethrough of stoppering rods 38 and stationary support rods 42 respectively, whereas blocks 30 for lowermost shelf #17 include a single opening 34 for passage of the stoppering rods 38.

Stationary support rods 42 are positioned adjacent each corner of chamber 12 (FIG. 5) and are rigidly secured to support members 50 (FIGS. 2 and 3) located at an uppermost portion of chamber 12. Stationary support rods 42, approximately 1" in diameter, support shelves #10 through #17 as well as shelf #1. Stationary support rods 42 may be restrained from movement by suitable anchoring means 52 secured to a floor portion of chamber 12.

Figure 7:
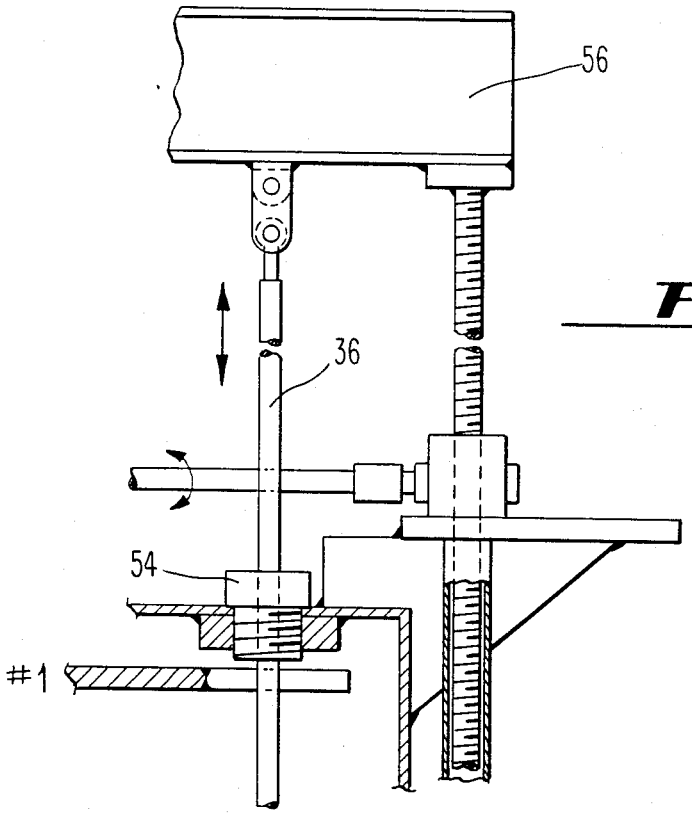

Upper shelves #2 through #9 are supported by four lifting rods 36, shorter in length than the stationary support rods and having a diameter of 1", for example. Lifting rods 36 extend upwardly through seal caps 54 provided in the roof of chamber 12 for coupling to an external, vertically movable lifting frame 56 (FIGS. 1, 2 and 7) which provides controlled vertical movement to lifting rods 36 and shelves #2 through #9.

Stoppering rods 38, typically $1\frac{1}{2}$" in diameter, are disposed between each stationary support rod 42 and lifting rod 36. Stoppering rods 38 extend upwardly from a rectangular framework 60 provided below lowermost shelf #17 (FIG. 2) through sealing caps 62 disposed through the roof of chamber 12, for coupling to lifting frame 64. Vertical motion of lifting frame 64 causes stoppering rods 38 to move in accordance therewith.

Axes of stationary support rods 42, stoppering rods 38, and lifting rods 36, form straight lines which are parallel to a chamber wall defining the depth of the present drying chamber.

Vertical movement of lifting frames 56 and 64 are similarly effected, and hence, description of mechanism pertaining to one is recited herein.

Figure 6:
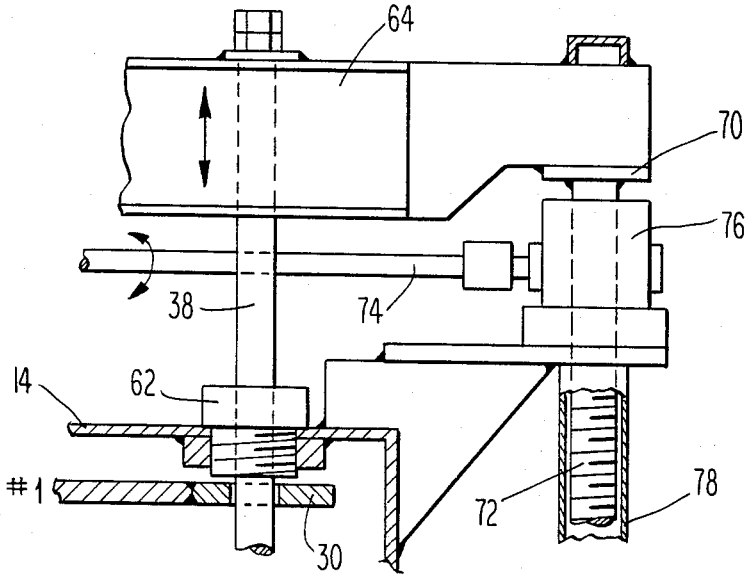
FIGS. 6 and 7 are sectional views looking in t direction of arrow 6—6 and 7—7 respectively of FI 1.

Thus, lifting frame 64 (FIGS. 1, 2 and 6) for example, typically comprises four I-beams welded into a rectangular configuration; more accurately, a pair of opposed longer sides of the configuration comprises two C-beams secured together in spaced back-to-back relationship. The frame 64 is secured upon pads 70 at each of its corners. Pads 70 are mounted upon vertically disposed screws 72, preferably of the self-locking Acme type. Screws 72 engage transverse drive worms 74 oriented at right angles thereto at a worm drive gear box 76. Lower ends of screws 72 are enclosed within grease wells 78 to insure adequate lubrication of the right angle drives. Drive worms 74 cooperate with gear means 80 (FIG. 1) which communicates with motor shaft 82 of drive motor 84. Thus, upon rotation of drive motor shaft 82 in one direction or the other, lifting frame 64 will move upwardly or downwardly.

Drive motor 90 effects vertical elevation and depression of lifting frame 56 (FIG. 7) and hence lifting rods 36, in a manner substantially analogous to the movement of lifting frame 64.

Each of the upper shelves #2 through #9 is supported on shelf support rings 100 (FIG. 4) immediately therebelow, the rings resting on collar clamps 102 which, in turn, contact retainer rings 104 engaging grooves circumscribing lifting rods 36. A plurality of such grooves is provided along each of the lifting rods 36 at preselected spaced increments, as well as along a portion of stationary support rods 42.

Figure 3:
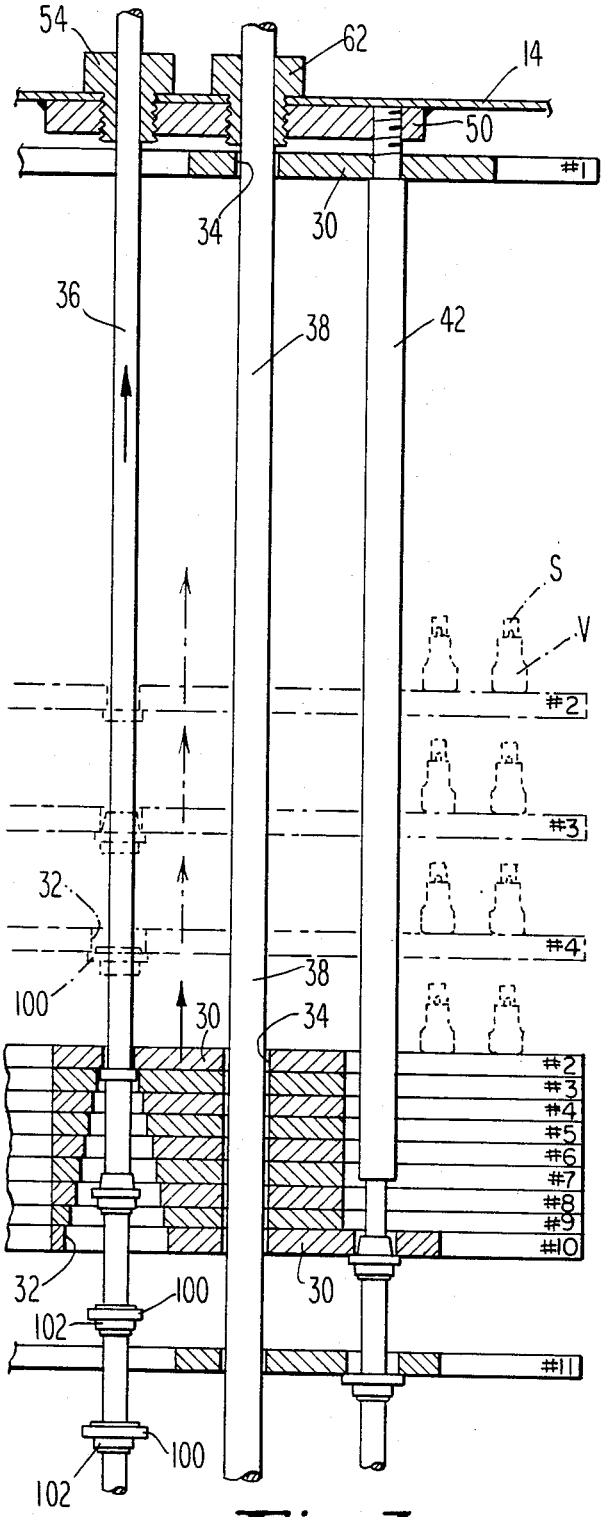
FIG. 3 is a sectional view of upper shelves of t freeze drying apparatus in stacked disposition, and se eral shelves being elevated therefrom, in phantom.
Figure 4:
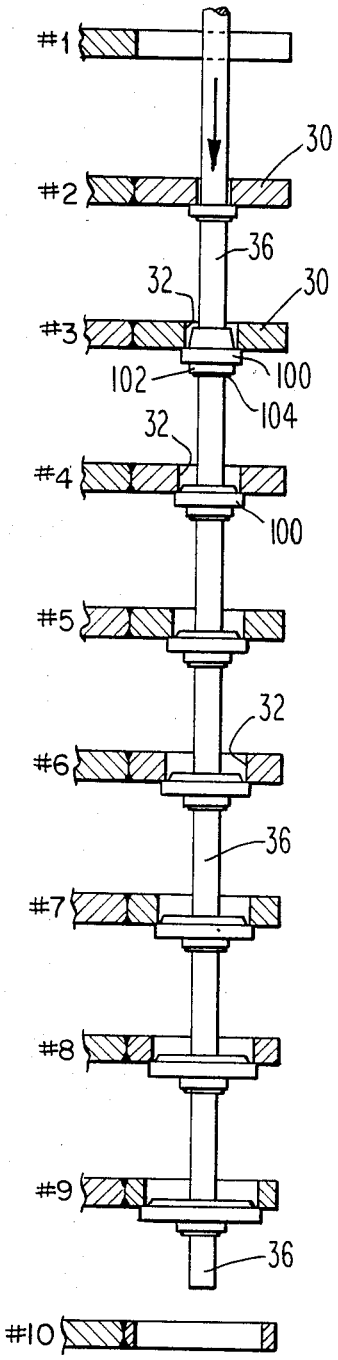
FIGS. 4 and 5 are sectional views taken along lin 4—4 and 5—5 respectively of FIG. 2.

It must be appreciated, however, that shelves #2 through #9 will not properly stack if openings 32 and shelf support rings 100 associated therewith are of an uniform size. Therefore, each opening 32, as well as its support ring 100, are made progressively larger in descending order of the upper shelves, i.e., shelf #2 through shelf #9, thus enabling each shelf support ring 100 to nest within the larger opening 32 of the shelf immediately therebelow during depression of the lifting rods 36, but of sufficiently large diameter to engage that portion of shelf support bracket 30 peripherally surrounding the smaller opening 32 of the shelf immediately thereabove during elevation of the lifting rods (FIG. 3).

Collar clamps 102 throughout the apparatus may be of uniform size, i.e., about $1\frac{3}{4}$" in diameter with a height of $\frac{1}{2}$". Each shelf support ring 100 of the apparatus will similarly be $\frac{1}{2}$" high, thus permitting shelf support rings 100 and collar clamps 102 to nest in coplanar relationship within a shelf having a thickness of 1", when the upper shelves are stacked. Support rings 100 are slidable on lifting rods 36 and stationary support rods 42.

More specifically, shelf #3, for example (FIG. 4), is associated with shelf support brackets 30 having openings 32 therein, typically 2" in diameter, the shelf being supported on shelf support rings 100 having a convenient diameter of $2\frac{1}{4}$". Shelf #4 may be supported on $2\frac{3}{4}$" diameter support rings 100 which contact openings of $2\frac{1}{2}$" provided in bracket 30 secured to shelf #4. Successively lower shelves having openings and rings associated therewith progressively increasing incrementally typically by ½" such that shelf #9 requires supporting rings having a diameter of 5¼" cooperating with 5" diameter bracket openings 32. Shelf #10 is provided with 5½" diameter openings 32 in bracket members 30 secured thereto in order to permit the passage therethrough of support rings associated with shelf #9 having a diameter of 5¼".

Since shelf #1 is fixed and does not move, openings 34 in its brackets 30 (FIG. 3) may be about 1¾" in diameter to permit passage of stoppering rods 38 having a diameter of 1½" therethrough.

Figure 2:
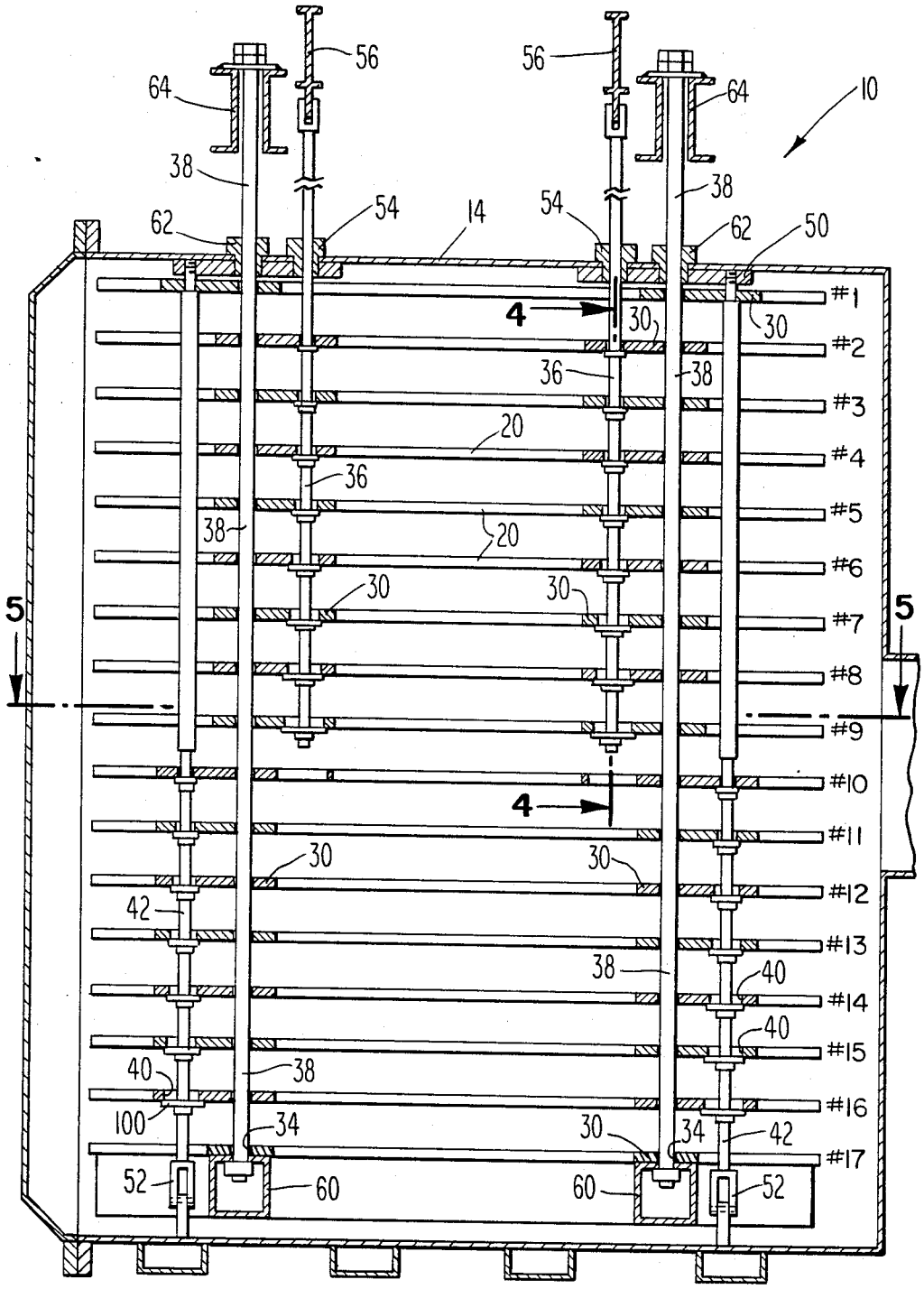
FIG. 2 is a sectional view of FIG. 1 taken substa tially along line 2—2 thereof.

Stationary support rods 42 support shelves #10 through #17 and shelf #1 (FIG. 2). Shelf #16, for example, is supported on shelf support rings 100 having a diameter of 5¼". Openings 40 in brackets 30 secured to shelf #16 have a diameter of 5". Thus, the support rings and openings associated with shelf #16 may be identical to the dimensions of their counterparts associated with shelf #9. Similarly, shelf #15 is associated with rings and openings equivalent to those associated with shelf #8, and so on. Shelf #9, as aforementioned, is supported by lifting rods 36.

Drive motor 84 cooperates with stoppering rods 38 to elevate lowermost shelf #17 and those shelves thereabove. The shelves are capable of thus being positioned in stacked or telescoped relationship below shelf #1.

After the vials with loosely engaging stoppers have been loaded onto shelves #17 through #2, stoppering rods 38 are elevated via lifting frame 64 and drive motor 84 by maintaining conventional "up" push button (not shown) depressed such that continuously slowly elevating shelf #17 urges the loosely engaged stoppers on the vials loaded onto shelf #17 tightly into their respective vials upon the stoppers contacting the undersurface of shelf #16. Next, the vials on shelf #16 become fully stoppered when the stoppers contact the undersurface of shelf #15. The large number of vials on each shelf is more than sufficient to smoothly transmit the continuous upward movement of the stoppering rods and shelves until the vials on shelf #2 become fully stoppered. Release of the push button, of course, will break the circuit to drive motor 84.

During stoppering, since brackets associated with a lower shelf are provided with larger openings than the shelf support rings associated with the shelf immediately thereabove, the shelves are capable of moving upwardly without any contact between openings and support rings.

When unloading, support shelf #10 is the first shelf to be unloaded, by depressing "down" button for drive motor 84 until shelf #10 rests on its support ring 100, Shelf #9 may then be stacked upon shelf #10 by depressing the "down" button controlling drive motor 90 associated with lifting frame 56 and lifting rods 36. After unloading shelf #9, shelf #8 may then be lowered for unloading, and so on. It is apparent that the lowering of shelf #9, for example, causes each of the upper movable shelves therabove to move downwardly in unison therewith since the openings 32 in brackets 30 associated with a particular shelf are smaller in diameter than the support rings 100 supporting that shelf.

When preparing for loading of another batch, the lower shelves are loaded up to and including shelf #11. Shelves #2 through #9 are next stacked onto unloaded shelf #10. The uppermost stacked shelf, i.e., shelf #2 is then loaded and elevated several inches by depressing "up" button activating drive motor 90. Shelf #3 is next loaded, elevated, and so on (FIG. 3). Shelf #10 may finally be loaded.

In those instances where the height of the vials V, including stoppers S (FIG. 3), is greater than the spaces provided between shelves, shelf support rings supporting shelf #16 are removed which permits it to be stacked onto shelf #17. Shelves #2 through #15 are then repositioned to apportion the additional spacing provided. If greater spacing is still desired, shelf #15 may be similarly stacked upon stacked shelf #16, and the repositioning procedure repeated. In the repositioning of shelves, predetermined locations of the grooves for retainer rings 104, and hence collar clamps 102 and support rings 100 are prearranged and fixed.

I claim:

1. Freeze drying apparatus comprising a chamber having a plurality of initially positioned, predeterminedly spaced, horizontally disposed, vertically aligned shelves supported therewithin, means for simultaneously depressing a plurality of upper of said shelves to form a progressively increasing stack thereof atop an intermediately disposed support shelf, means for controllably elevating each of said stacked shelves successively to said initially predeterminedly spaced disposition, and additional means for elevating each shelf within said chamber disposed below uppermost of said shelves to decrease said predeterminedly spaced distance between adjacent shelves.

2. Apparatus of claim 1 wherein said chamber is a vacuum drying chamber.

3. Apparatus of claim 2 wherein means are provided for evacuating said chamber, and other means for refrigerating and heating said shelves.

4. Apparatus of claim 1 wherein said means for depressing said upper shelves comprises a plurality of lifting rods vertically movable within said chamber, said lifting rods articulating with each of said upper shelves for controlling vertical movement thereof.

5. Apparatus of claim 4 wherein each of said upper shelves and said support shelf cooperate with openings associated therewith which progressively increase in diameter from an uppermost of said upper shelves through said support shelf, spaced support rings slidably mounted to each of said lifting rods, said rings capable of supporting shelf immediately thereabove and aligned with said openings, each of said support rings progressively increasing in diameter in descending order of said upper shelves, each of said support rings being larger in diameter than opening immediately thereabove and smaller in diameter than diameter of opening associated with shelf immediately therebelow whereby lowering of said lifting rods permits said upper shelves to sequentially stack upon said support shelf.

6. Apparatus of claim 5 wherein said support rings supporting lowermost of said upper shelves pass through openings associated with said support shelf.

7. Apparatus of claim 5 wherein said slidably mounted support rings are supported by collar clamps predeterminedly spaced and secured around said lifting rods.

8. Apparatus of claim 5 wherein elevation of said lifting rods causes said upper shelves to be sequentially arranged at their initially predeterminedly spaced locations.

9. Apparatus of claim 5 wherein said openings are provided in shelf support bracket members secured to and extending outwardly in opposed relationship from each of said upper shelves from two opposed sides thereof.

10. Apparatus of claim 1 wherein said additional means for elevating each shelf within said chamber comprises a plurality of stoppering rods vertically movable within said chamber and articulating with each shelf predeterminedly spaced therein, a plurality of stationary support rods vertically mounted within said chamber adjacent said stoppering rods and articulating with said support shelf and shelves therebelow, said support shelf and shelves therebelow cooperating with openings associated therewith which progressively increase in diameter from said support shelf through next to lowermost of said shelves, support rings slidably mounted to said stationary support rods below said openings and aligned therewith for support of shelf immediately thereabove, each of said rings progressively increasing in diameter in descending order from said support shelf, each of said support rings being larger in diameter than opening immediately thereabove and smaller in diameter than diameter of opening associated with shelf immediately therebelow whereby elevation of said stoppering rods causes lowermost of said shelves to move upwardly and those shelves thereabove sequentially thereafter to decrease said predeterminedly spaced distance between adjacent shelves.

11. Apparatus of claim 10 further characterized by means for lowering said stoppering rods which returns each shelf to said initially predeterminedly spaced disposition within said chamber.

12. Apparatus of claim 10 wherein a plurality of stoppered containers disposed on each shelf below said uppermost shelf defines said decreased distance between adjacent shelves.

13. Apparatus of claim 12 wherein said stoppered containers on any single shelf within said chamber are of uniform height.

* * * * *